US005425293A

United States Patent [19]

Nakazato et al.

[11] Patent Number: 5,425,293

[45] Date of Patent: Jun. 20, 1995

[54] TOOL FOR HANDLING A STRIKING SCREW

[75] Inventors: Takashi Nakazato; Takumi Harigaya, both of Tokyo, Japan

[73] Assignee: Max Co., Ltd., Tokyo, Japan

[21] Appl. No.: 135,983

[22] Filed: Oct. 14, 1993

[30] Foreign Application Priority Data

Oct. 15, 1992 [JP] Japan ..... 4-078046 U
Feb. 17, 1993 [JP] Japan ..... 5-010639 U

[51] Int. Cl.[6] ..... B25B 19/00
[52] U.S. Cl. ..... 81/464; 81/433
[58] Field of Search ..... 81/463, 464, 57.11, 81/57.12, 57.28, 57.37, 433; 173/104–109, 213

[56] References Cited

U.S. PATENT DOCUMENTS 3,550,243 12/1970 Allsop ..... 81/464 X
4,581,964 4/1986 Takatsuru ..... 81/464

FOREIGN PATENT DOCUMENTS 0480347 4/1992 European Pat. Off. .
1131768 10/1968 United Kingdom .
1236003 6/1971 United Kingdom .
1238300 7/1971 United Kingdom .
1363159 8/1974 United Kingdom .
9111295 8/1991 WIPO .

*Primary Examiner*—D. S. Meislin
*Attorney, Agent, or Firm*—Cushman Darby & Cushman

[57] ABSTRACT

A driver bit holding sleeve 6 is disposed in a shooting portion 4 so as to enable it to be rotated together with a driver bit 5 struck by a striking piston 2 while permitting the driver bit 5 to be slidably displaced in the shooting portion 4, and a piston-cylinder mechanism 10 for rotationally driving the holding sleeve 6 is arranged in the vicinity of the shooting portion 4. The piston-cylinder mechanism 10 is operatively associated with the holding sleeve 6 via a converting mechanism 17 for converting reciprocable linear movement of the piston-cylinder mechanism 10 into rotary movement of the holding sleeve 6. Since a striking sleeve 7 is threadably squeezed in a material to be handled after it is struck by a driver bit 5, any type of striking screw 7 having a circular head portion can easily and reliably be struck in the material.

12 Claims, 8 Drawing Sheets

TOOL FOR HANDLING A STRIKING SCREW

BACKGROUND OF THE INVENTION

The present invention relates to a tool for handling a striking screw wherein the screw is axially driven into a material to handled until it reaches a predetermined depth, and thereafter, it is rotatably driven.

Generally, a striking screw is first axially struck or hammered into a material to be handled until it reaches a predetermined depth, and thereafter, it is rotatably driven, or screwed, further into the material. Such a striking screw has two advantages, one of them being that it can be hammered quickly into a material to be handled like a nail, and the other being that it is securely driven into the material. A conventional tool for handling a striking screw of the foregoing type is constructed such that a striking screw fed from a magazine into a shooting portion is first hammered by actuating a driver. Thereafter, it is fitted at the foremost end of the shooting portion into a socket having a polygonal hole formed therein. It is then rotatably driven in the material to be handled by rotating the socket. With this construction, the conventional tool can be used only with a screw having an enlarged head portion corresponding to the contour of a socket portion. For this reason, the conventional tool cannot be used with a screw having an engagement groove or an standard engagement hole such as a plus character-shaped groove (a "Phillips"-type groove), a minus character-shaped groove, a hexagonal hole, or the like formed on the surface of a circular head portion thereof. Similarly, the conventional tool can not be used for a screw to be driven into gypsum board or a similar material This is because when a screw having a polygonal head portion is used for the gypsum board, a paper backing placed on the surface of the gypsum board is broken or torn by the polygonal head portion or by the corners of a socket portion of the screw so that the gypsum board fails to be retained by the head portion of the screw. This makes the joint strength of the gypsum board undesirably low.

With this in mind, it is difficult to tighten the screw without leaving the head portion protruding from the surface of the gypsum board when it is rotatably driven into the gypsum board.

SUMMARY OF THE INVENTION

The present invention has been made in consideration of the aforementioned background. Its objective is to provide a tool for handling a striking screw having an engagement groove to be engaged with a driver bit. The foremost end part of the driver bit used for hammering the screw is also used as a screw tightening bit. Thus, the screw can be rotatably driven hammering the screw by rotating the driver bit after the screw is hammered by the driver bit.

To accomplish the above object, a first aspect of the present invention provides a tool for handling a striking screw comprising: an axial driving mechanism for driving the striking screw in an axial direction of the striking screw, the driving mechanism being provided with a driver bit (5) having a screw engagement portion formed at its foremost end for engaging with an engagement groove formed in the head portion of the striking screw to be driven; a guiding mechanism for preventing the driver bit from rotating in a screwing direction of the striking screw while the striking screw is axially driven (i.e. hammered) and for guiding a movement of the driver bit in the axial direction of the striking screw; and a mechanism for rotating the driver bit in such a manner that the axially driven striking screw driven by the axial driving mechanism is rotatably driven by the driver bit together with the guiding mechanism in the screwing direction.

In addition, to accomplish the above object, a second aspect of the present invention provides a tool for handling a striking screw which includes an axial striking cylinder having a striking piston slidably received therein, and a driver bit rotatably supported by the striking piston to allow the slidable displacement of the driver bit to be properly guided in a shooting portion formed at one end of the striking cylinder. An engagement portion adapted to engage an engagement groove formed in a head portion of the striking screw is formed at the foremost end of the driver bit. A driver bit holding sleeve is disposed in the shooting portion to enable the holding portion to be rotated in the same direction with the driver bit while permitting the slidable displacement of the driver bit across the whole length of a slidable displacement stroke of the driver bit. A piston-cylinder mechanism including a driving piston, adapted to be reciprocably displaced within a predetermined stroke range, is arranged adjacent to the shooting portion. The piston-cylinder mechanism is operatively associated with the holding sleeve via a converting mechanism for converting reciprocable linear movement of the driving piston into rotary movement of the holding sleeve.

It is preferable that after the striking piston reaches a lower dead point position after the screw is hammered, the screw struck by the striking piston is rotatably driven by the driver bit in the screwing direction by slidably displacing the driver bit further in the downward direction in the direction toward the lower dead point while rotating the driver bit.

The present invention may be carried out in the following manner. Specifically, a ground contacting member projecting from the lowermost end of the shooting portion is arranged around the shooting portion. When the striking piston reaches the lower dead point, the ground contacting member is released from its supported state so the striking screw can be rotatably driven further by the rotational power applied to the tool housing.

With the tool constructed in the above-described manner, the engagement portion of the driver bit always assumes a known attitude every time a striking screw is struck by the striking piston. Thus, provided that an engagement groove formed in a head portion of the striking screw assumes an attitude corresponding to that of the engagement portion of the driver bit, the engagement groove formed in the head portion of the striking screw is therefore not undesirably damaged or injured by the driver bit when the striking screw is hammered thereby. Since the striking screw is rotatably driven after completion of the screw striking operation, the circular head portion of the striking screw can easily and reliably be screwed into a material to be handled. Therefore, if the material to be handled is a gypsum board or the like, a striking screw such as a dry wall screw or the like can be rotatably driven into the material, resulting in each striking/screwing operation being achieved with a remarkably improved efficiency.

With the tool according to the present invention, since rotatable driving can be effected while the head portion of the striking screw is held in the shooting portion, a rotatable driving operation to be performed after completion of the screw striking can be achieved more easily and reliably.

Further, to accomplish the above object, a third aspect of the present invention provides an apparatus for striking and rotatably driving screw. The apparatus is characterized in that a spirally extending ribbon-shaped projection and a spirally extending groove are formed on a driver bit and a bit guide, respectively, for guiding the slidable movement of the driver bit in the rotational direction to apply a certain intensity of rotational power to the screw via the operative engagement of the spirally extending ribbon-shaped projection with the spirally extending groove when the screw is driven in the striking direction. The bit guide is operatively associated with driving means for rotating the bit guide in the screwing direction. A striking piston of the apparatus is rotatably supported for actuating the driver bit with a large magnitude of impact in the axial striking direction. When the screw is struck by the driver bit, the bit guide is kept immovable (i.e., non-rotating). After completion of the striking operation, the bit guide is rotated to rotatably drive the screw further.

With the apparatus constructed in the above-described manner, when the striking piston is driven in the downward direction at the time of screw striking, the bit guide is kept immovable but a certain intensity of rotational power is applied to the driver bit in the unscrewing direction via the operative association of the spirally extending ribbon-shaped projection with the spirally extending groove. Thus, the driver bit is actuated in the striking direction while rotating until the foremost end part of the driver bit is engaged with the grooved screw head.

When the screw is rotatably driven, a certain intensity of thrusting force is applied to the driver bit in the screwing direction via the operative engagement of the spirally extending ribbon-shaped projection with the spirally extending groove as the bit guide is rotated. Thus, the engagement portion of the driver bit at the foremost end part of the later is driven in the driving direction until it is reliably engaged with the engagement groove formed in the head portion of the screw.

DETAILED DESCRIPTION OF THE PREFERRED EMBODIMENTS

The present invention will now be described in detail hereinafter with reference to the accompanying drawings which illustrate preferred embodiments thereof.

Figure 1:
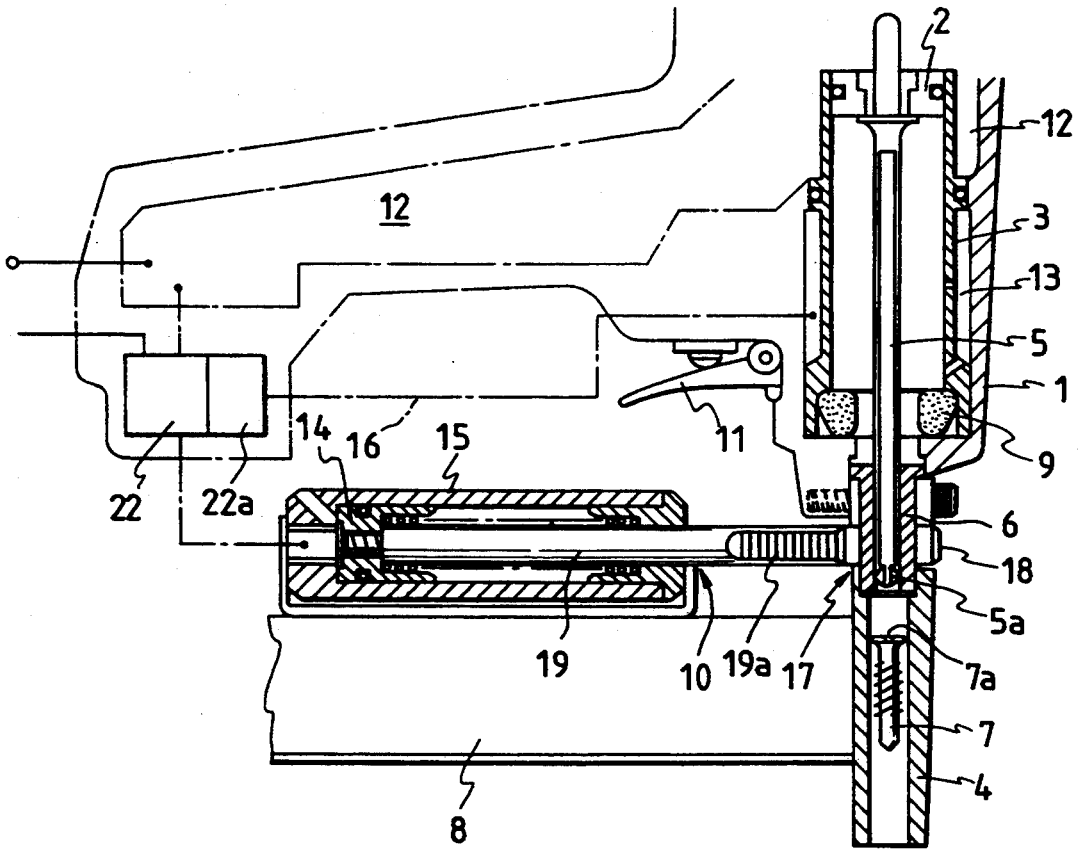
FIG. 1 is a sectional view of a tool for handing a striking screw according to an embodiment of the present invention, particularly showing essential components constituting the tool.

FIG. 1 shows by way of vertical sectional view essential components constituting a tool for handling a striking screw according to a first embodiment of the present invention. Specifically, the tool includes a tool housing 1, a striking cylinder 3 having a striking piston 2 slidably received therein, a shooting portion 4 extending downward of the striking cylinder 3, and a driver bit 5 rotatably suspended from the striking piston 2 so as to be displaced in the shooting portion 4 in an upward/-downward direction. To properly hold the driver bit 5, a holding sleeve 6 is rotatably disposed in the shooting portion 4. In addition, a piston-cylinder mechanism 10 for rotatably driving the holding sleeve 6 is arranged above a magazine 8 (for feeding a striking screw 7 to the shooting portion 4). In this embodiment, it is assumed that a plus character-shaped engagement groove 7*a* (i.e., Phillips-type) is formed on the surface of a head portion of the striking screw 7 to be handled in the tool housing 1.

A striking mechanism composed of the striking cylinder 3 and the striking piston 2 is constructed in the same manner as a conventional, pneumatic driven type nail striking machine. Specifically, as a driving mechanism (operable with a compressed air supply source P (not shown) as a driving power source) is actuated by pulling a trigger lever 11 with an operator's finger, compressed air in a main air chamber 12 of the tool housing 1 is impulsively introduced into the striking cylinder 3 to drive the striking piston 2, causing the driver bit 5 to be actuated with a large magnitude of impact. Subsequently, a part of the compressed air consumed during the striking operation of the striking piston 2 is accumulated in a blow-back chamber 13. The striking piston 2 located at the lower dead point position is later returned to the upper dead point by utilizing the compressed air accumulated in the blow-back chamber 13. Incidentally, when the striking piston 2 is located at the lower dead point where it comes in contact with a damper 9, the lowermost end of the driver bit 5 extends from the shooting portion 4.

The upper end part of the driver bit 5 is supported such that it is rotatable relative to the striking piston 2, while the lower end part of the same is supported such that slidable movement of the driver bit 5 is properly guided in the shooting portion 4. Phillips-type engagement portion 5*a*, adapted to be engaged with an engagement groove 7*a* formed in a head portion of the striking screw 7, is formed at the lower end part of the driver bit 5.

The holding sleeve 6 is rotatably supported in the shooting portion 4, and the driver bit 5 is rotatably held in the holding sleeve 6. The inner wall surface of the holding sleeve 6 is designed to exhibit the substantially same configuration (e.g., polygonal configuration) as that of the outer surface of the driver bit 5. Thus, the holding sleeve 6 permits the driver bit 5 to slidably move axially across the whole length of a slidable movement stroke thereof while rotating together with the driver bit 5 in the same direction.

A plurality of striking screws 7 are received in magazine 8 so that they are successively fed to the shooting portion 4 by actuating a feeding mechanism (not shown). It is assumed that each striking screw 7 is fed to the shooting portion 4 in such a manner that the engagement groove 7*a* formed in the head portion of the striking screw 7 is always oriented in the shooting portion 4 in the same direction, (i.e., it is positionally aligned with the engagement portion 5*a* of the driver bit 5 at the lowermost end of the latter).

To rotatably drive the holding sleeve 6, the piston-cylinder mechanism 10 is arranged above the magazine 8 in the vicinity of the shooting portion 4 so that the driving piston 14 is reciprocably displaced within a predetermined stroke range in the piston-cylinder mechanism 10. The rear end of a driving cylinder 15 communicates with the main chamber 12 via a three-way valve 22. When the three-way valve 22 is actuated in a certain direction, compressed air is introduced into the driving cylinder 15 from the main chamber 12 via the three-way valve 22. In addition, the rear end of the driving cylinder 15 communicates with an exhaust port (not shown). To assure that the three-way valve 22 is actuated by the compressed air fed from the blow-back chamber 13, it communicates with the blow-back chamber 13 via an air path 16. A speed controller 22*a* (serving as a throttle regulating unit for the air path 16) is disposed at an intermediate position of the air path 16 to enable the timing relationship of the driving piston 14 relative to the driving cylinder 15 to be adequately regulated. The piston-cylinder mechanism 10 is operatively associated with the holding sleeve 6 via a converting mechanism 17 which serves to convert reciprocable linear movement of the piston-cylinder mechanism 10 into rotary movement of the holding sleeve 6. This converting mechanism 17 is composed of a gear 18 fixedly fitted onto the holding sleeve 6 and a rack 19*a* of a rack member 19 integrally fixed to the driving piston 14, and the gear 18 of the holding sleeve 6 meshes with the rack 19*a* of the rack member 19.

Figure 2:
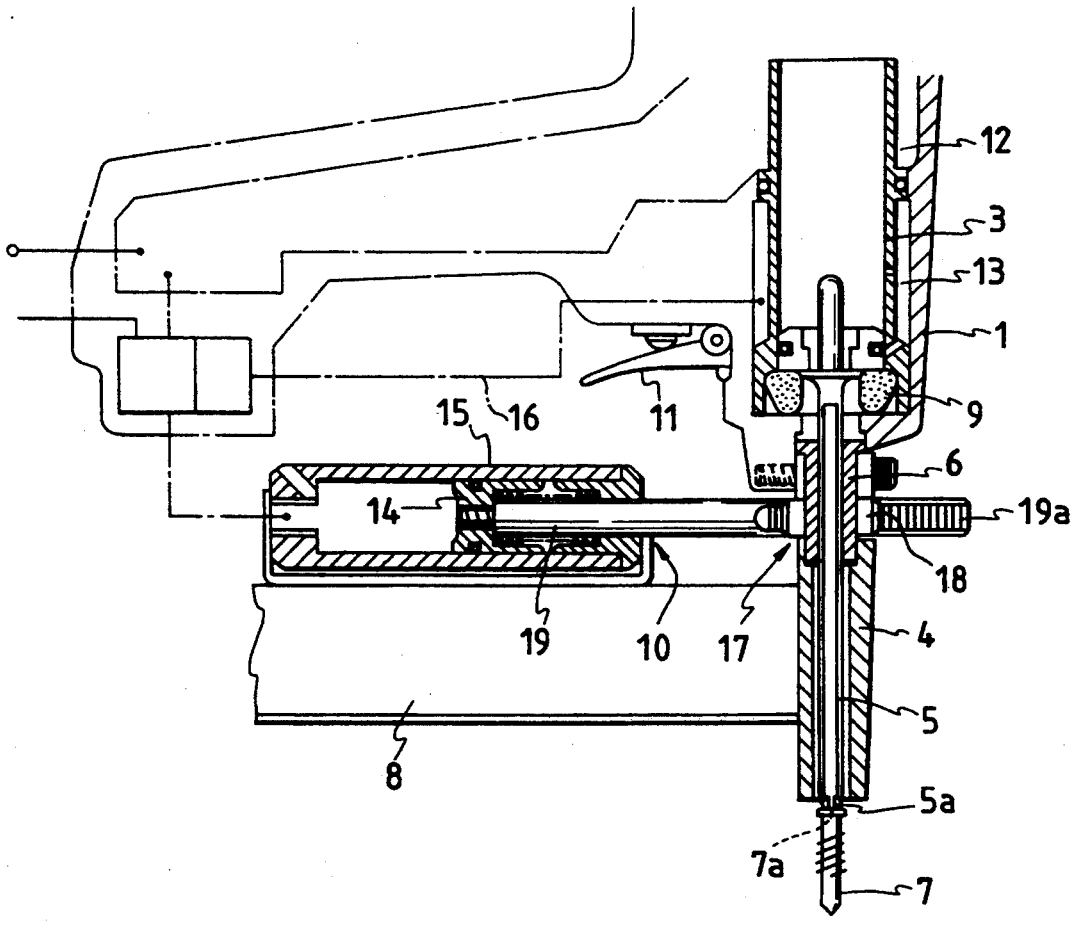
FIG. 2 is a sectional view of the tool shown in FIG. 1, particularly showing a step of rotatably driving the screw.

With the tool constructed in the above-described manner, when a trigger lever 11 is actuated with an operator's finger, the striking mechanism is activated to drive the striking piston 2 with a large magnitude of impact as shown in FIG. 2, causing a striking screw 7 held in the shooting portion 4 to be struck or hammered by the striking piston 2. At this time, since the engagement portion 5*a* of the driver bit 5 is properly aligned with the engagement groove 7*a* formed in a head portion of the striking screw 7, the engagement groove 7*a* of the striking screw 7 is not damaged or injured by the striking piston 2 which has been actuated in that way. As the striking piston 2 is displaced in the downward direction, the driver bit 5 is slidably displaced along the inner wall surface of the holding sleeve 6 so that the striking screw 7 is hammered and driven axially downward of the lowermost end of the shooting portion 4. While the foregoing state is maintained, the grooved head portion of the striking screw 7 remains raised up in a floated state away from the surface of a material to be handled. Subsequently, a part of the compressed air accumulated in the blow-back chamber 13 at the time of screw striking is introduced into the three-way valve 22 via the air path 16, causing the three-way valve 22 to be actuated in a certain direction. In response to the actuation of the three-way valve 22, compressed air in the main chamber 12 is introduced into the driving cylinder 15 of the piston-cylinder mechanism 10, causing the driving piston 14 to be driven with the compressed air, whereby the rack member 19 is displaced in the forward direction so as to allow the holding sleeve 6 to be rotated together with the gear 18 meshing with the rack 19*a* of the rack member 19. As the holding sleeve 6 is rotated, the driver bit 5 is rotated together with the holding sleeve 6. At this time, since the engagement portion 5*a* of the driver bit 5 is engaged with the engagement groove 7*a* formed in the head portion of the striking screw 7t the rotation of the driver bit 5 causes the striking screw 7 to be rotated so as to screwed the striking screw 7 into the material to be handled until the screwing operation is completed. Thereafter, when the trigger lever 11 is released from the actuated state, the striking piston 2 is displaced in the rearward direction by the compressed air remaining in the blow-back chamber 13. Similarly, the driving piston 15 of the piston-cylinder mechanism 10 is displaced in the rearward direction by the resilient power of a coil spring. On completion of the rearward displacement of the driving piston 14, the engagement portion 5*a* of the driver bit 5 assumes the same attitude again as that before the preceding striking/screwing operation. Now, the tool is ready to start a next striking/screwing operation.

When a screw is hammered with a large magnitude of impact by the striking piston 2, the driver bit 5 is sometimes instantaneously disengaged from the screw 7 because of the upward bounding or recoil action of the tool attributable to the reactive power induced at the time of screw striking. In addition, when the three-way valve 22 is actuated immediately in response to the air pressure signal outputted from the blow-back chamber 13, the driver bit 5 can be rotated without any operative engagement with the screw 7, so that the screwing operation is not achieved or is incompletely achieved. In view of the foregoing problems, in this embodiment, speed controller 22*a* is arranged at the intermediate position of the air path 16 so as to properly adjust the timing relationship of the three-way valve 22 relative to the striking piston 2. The arrangement of the speed controller 22*a* makes it possible to obviate the foregoing malfunctions by adequately delaying the actuation of the three-way valve 22 from the screw striking operation.

As long as the engagement groove 7*a* of the striking screw 7 is positionally aligned with the engagement portion 5*a* of the driver bit 5, any other type of striking screw can be employed for the tool regardless of the contour of a head portion thereof. In this embodiment, the driving piston 14 of the piston-cylinder mechanism 10 is driven using the compressed air remaining in the blow-back chamber 13 as mentioned above. Alternatively, the driving piston 14 of the piston-cylinder mechanism 10 may be driven using the compressed air fed from the main chamber 12.

As is apparent from the above description with the tool constructed in the above-described manner, since the engagement portion 5a of the driver bit 5 is always oriented in a predetermined direction every time a striking screw 7 is struck by the striking piston 2, the engagement groove **7*a* formed in the head portion of the striking screw 7 is not damaged or injured by the driving bit 5, provided that an engagement groove 7*a* of each striking screw 7 is oriented in the foregoing predetermined direction. Since the striking screw 7 is rotatably driven (i.e. screwed) after it is struck by the striking piston 2, the circular configuration of the head portion of the striking screw 7** makes it easy and reliable to hammer it into a material to be handled. Accordingly, a striking screw such as a dry wall screw or the like can be hammered into the material to be handled such as a gypsum board or the like, resulting in operational performances of the tool being remarkably improved.

Figure 3:
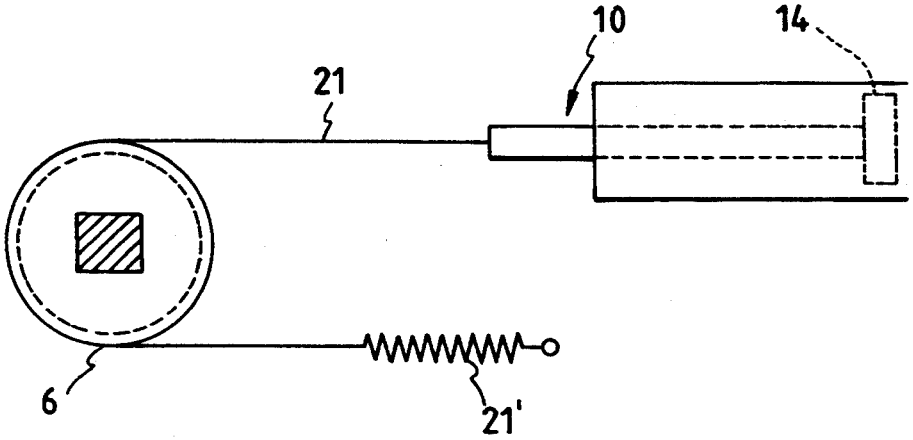
FIG. 3 is a schematic illustrative view of a converting mechanism for converting linear movement of a driving-piston into rotary movement of a holding sleeve according to second embodiment of the present invention.

Incidentally, the converting mechanism 17 for converting linear movement of the piston-cylinder mechanism 10 into rotary movement of the holding sleeve 6 should not be necessarily limited only to a gear-rack mechanism as mentioned above. Alternatively, for example, as shown in FIG. 3, the converting mechanism 17 may be constructed such that a wire 21 extending from the driving piston 14 of the piston-cylinder mechanism 10 is wound around a holding sleeve 6 by two or three turns and the rearmost end of the wire 21 is resiliently connected to a tension spring 21' so that the holding sleeve 6 is reciprocably rotated with a high accuracy in the presence of the friction arising due to repeated turning of the wire 21 around the holding sleeve 6. Otherwise, a chain may be substituted for the wire 21.

To assure that a screwing operation to be performed with the tool after completion of each screw striking operation is easily and reliably achieved, it is preferable that the screwing process is effected while the head portion of the striking screw 7 is held in the shooting portion 4. To this end, it is preferable that one of the following mechanisms is employed for the tool. (1) A mechanism which is constructed such that after the striking piston 2 reaches the lower dead point, the driver bit 5 is driven further in the downward direction coincident with the direction toward the lower dead point of the striking piston 2 so that the striking screw 7 is rotatably driven further in the screwing direction (i.e., a mechanism for displacing the driver bit 5 further relative to the striking piston). (2) A mechanism which is constructed such that a ground contacting member is arranged for normally supporting the lowermost end of the shooting portion 4 away from the surface of a material to be handled so that the striking screw 7 is rotatably driven further by the force imparted by the tool housing 1 after the ground contacting member is released from the supported state when the striking piston 2 reaches the lower dead point (i.e., a mechanism for displacing the driver bit further relative to the shooting portion).

The detailed structure of each of the mechanisms as explained in the paragraph (1) and the mechanism as explained in the paragraph (2) will be described below.

Figure 4:
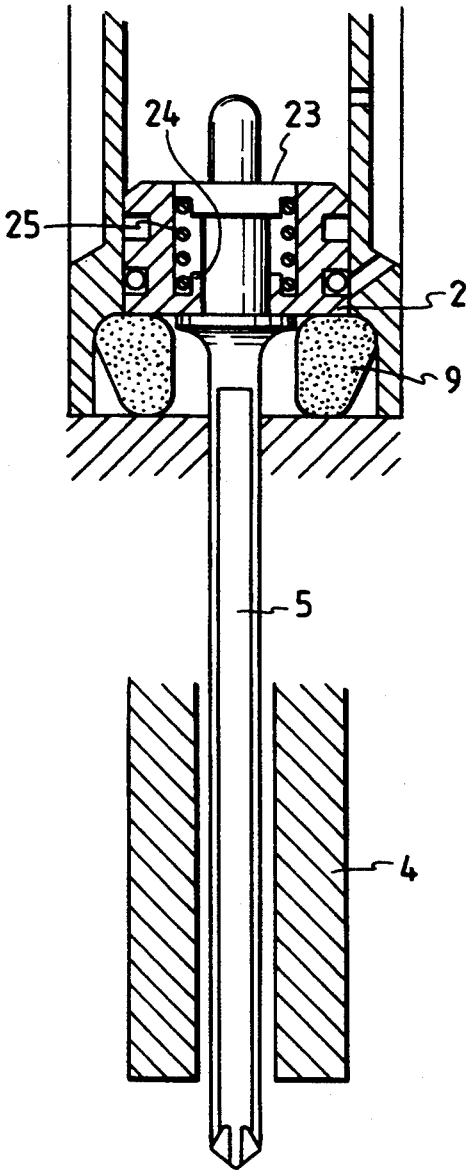
FIG. 4 is an enlarged sectional view of the tool, particularly showing a mechanism for displacing a driver bit relative to a striking piston according to third embodiment of the present invention.
Figure 5:
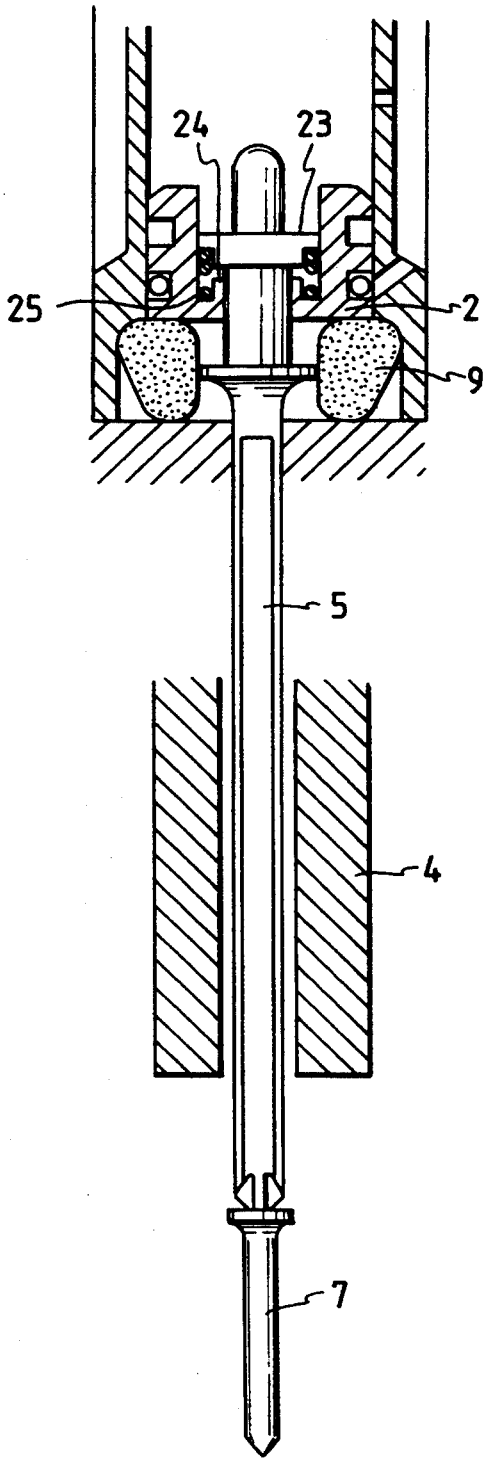
FIG. 5 is an enlarged sectional view of the tool similar to FIG. 4, particularly showing a step of rotatable driving a screw.

FIG. 4 and FIG. 5 show by way of sectional views the mechanism as explained in the paragraph (1). The driver bit 5 includes a flange portion 23 at the upper end part thereof, and the flange portion 23 is fitted into a cavity 24 which is formed in the upper part of the striking piston 2. In addition, a compression spring 25 is interposed between the flange portion 23 and the bottom surface of the cavity 24.

With such construction, since the driver bit 5 is squeezed via the flange portion 23 by the pressure of the compressed air filled in the striking cylinder 3 after the striking piston 2 reaches the lower dead point to come in contact with a damper 9, it is displaced further against the resilient power of the compression spring 25 in the downward direction coincident with the direction toward the lower dead point of the driving piston 2. Thus, after the driver bit 5 is struck by the striking piston 2, it is also rotatably driven further in the screwing direction. Accordingly, the driver bit 5 is supported in such a manner that the lowermost end of the driver bit 5 is not initially projected downward of the lower end of the shooting portion 4 when the striking piston 2 reaches the lower dead point at the time or screw striking, but is projected downward from the lower end of the shooting portion 4 on completion of each screwing operation. In this case, since the head portion of the striking screw 7 remains in the shooting portion 4 at the time of hammering the screw, the engagement portion **5*a* of the driver bit 5 at the lowermost end part of the latter is hardly disengaged from the engagement groove 7*a* formed in the head portion of the striking screw 7**. While the foregoing state is maintained, a next screwing operation can be easily and reliably achieved.

Figure 6:
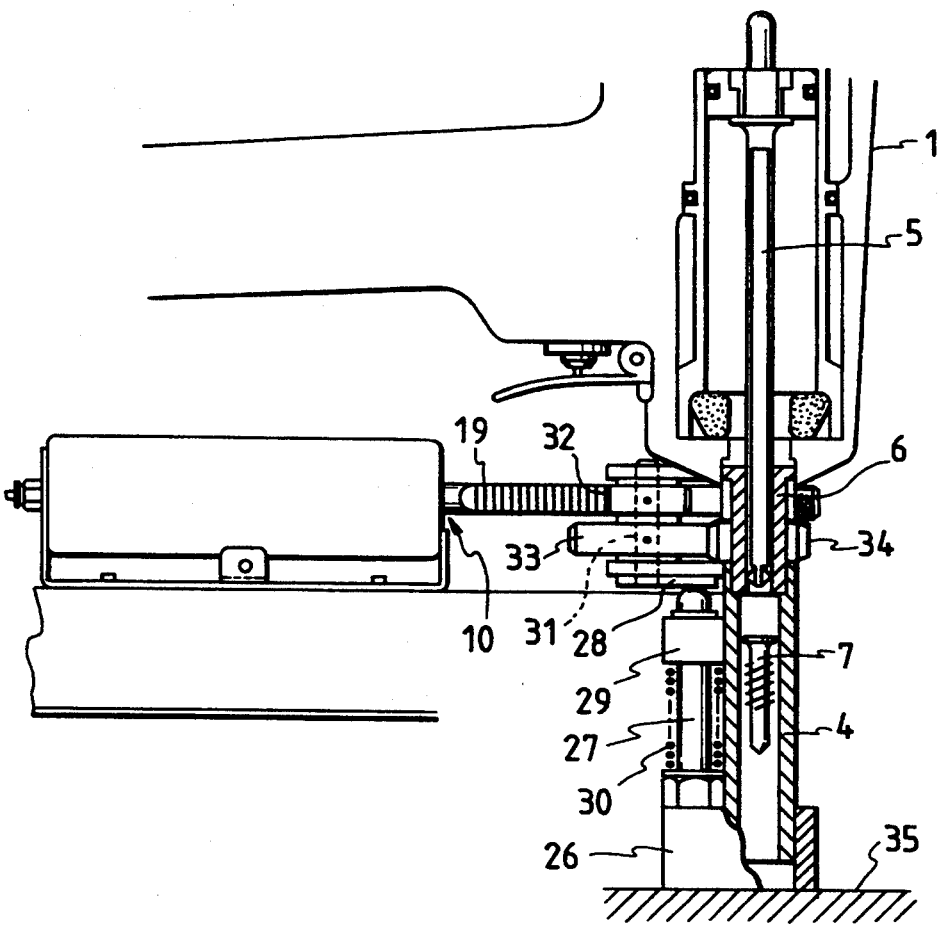
FIG. 6 is an illustrative view of the tool, particularly showing a mechanism for displacing a driver bit relative to a shooting portion according to a modified embodiment of the present invention.
Figure 7:
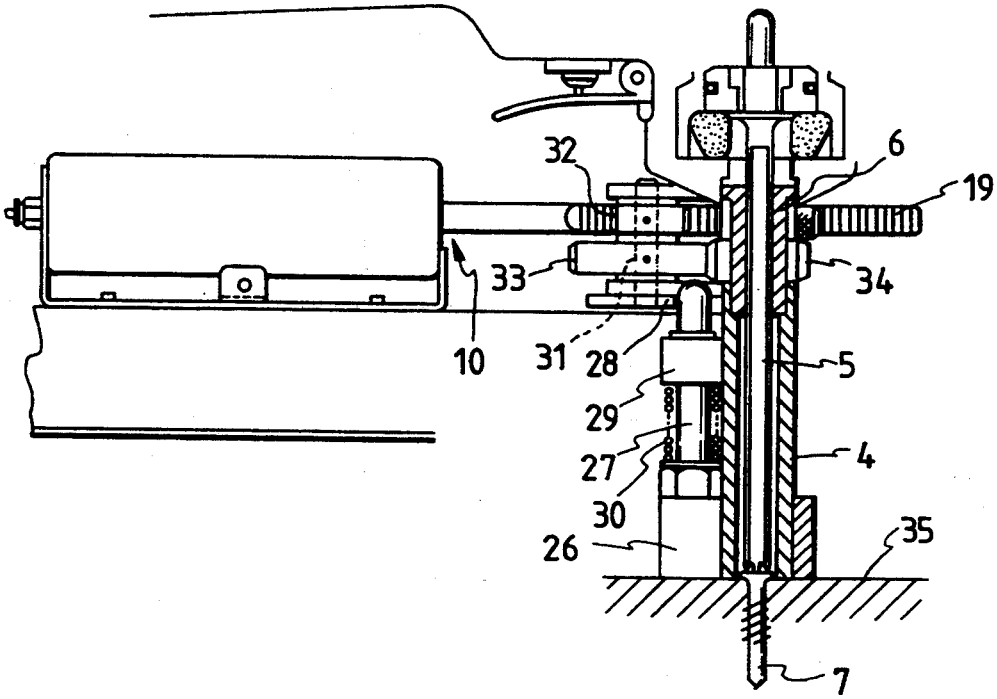
FIG. 7 is an illustrative view of the tool shown in FIG. 6, particularly showing a step of rotatably driving a screw.
Figure 8:
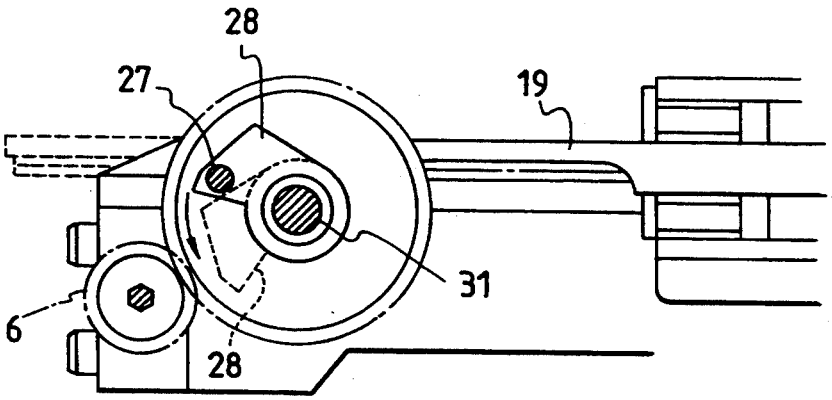
FIG. 8 is a fragmentary plan view of the tool shown in FIG. 6, particularly showing a rotary arm and associated components.
Figure 9:
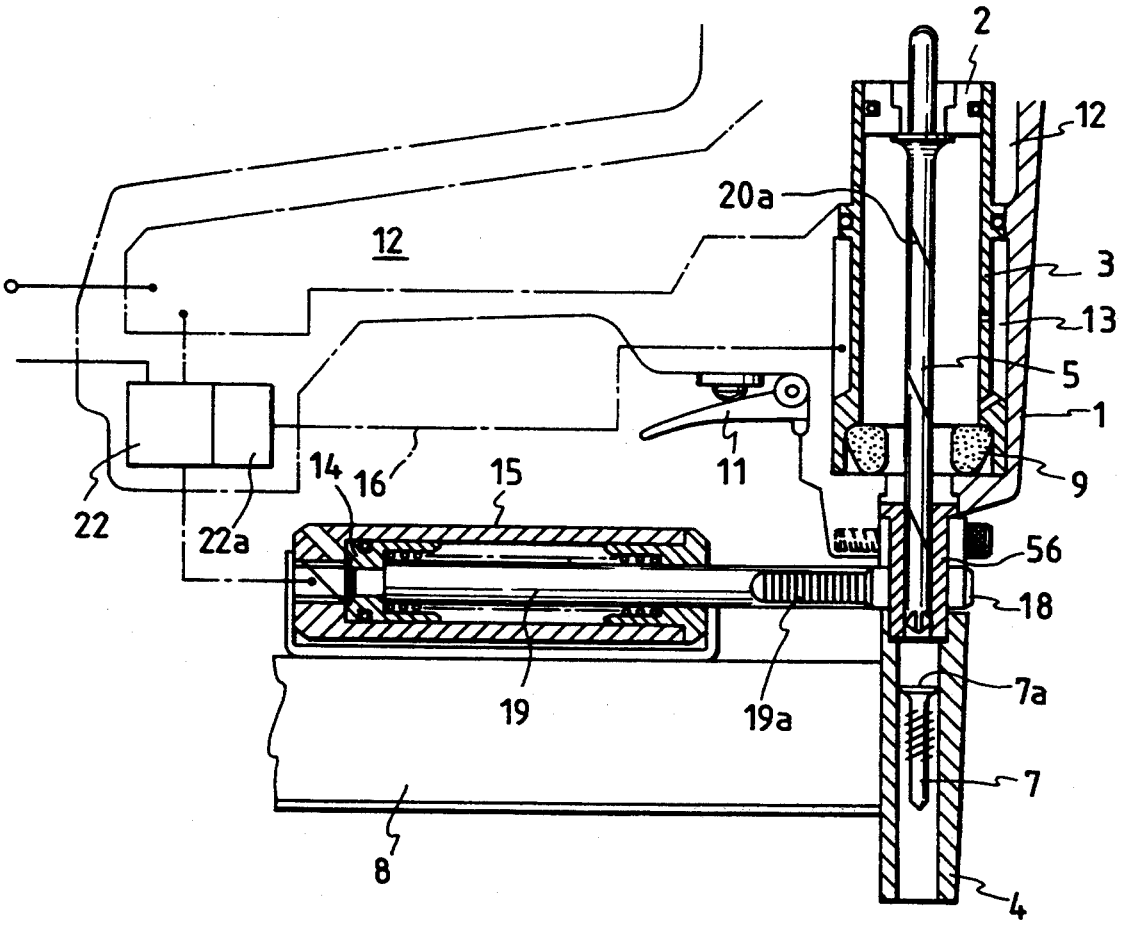
FIG. 9 is a sectional view of an apparatus for striking and threadably squeezing a screw according to a fourth embodiment of the present invention, particularly showing the structure of the apparatus.
Figure 10:
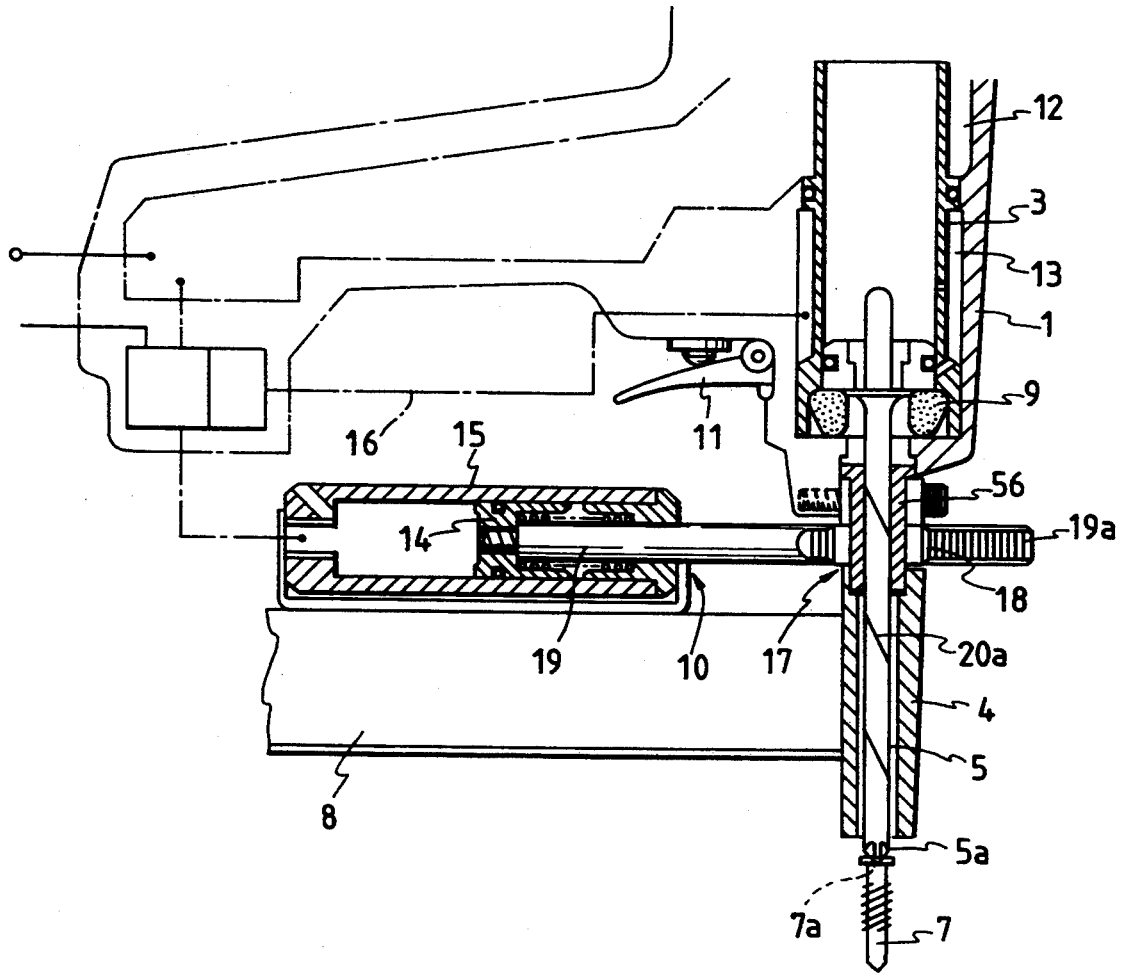
FIG. 10 is a sectional view of the apparatus shown in FIG. 9, particularly showing a step of rotatably driving the screw.
Figure 11:
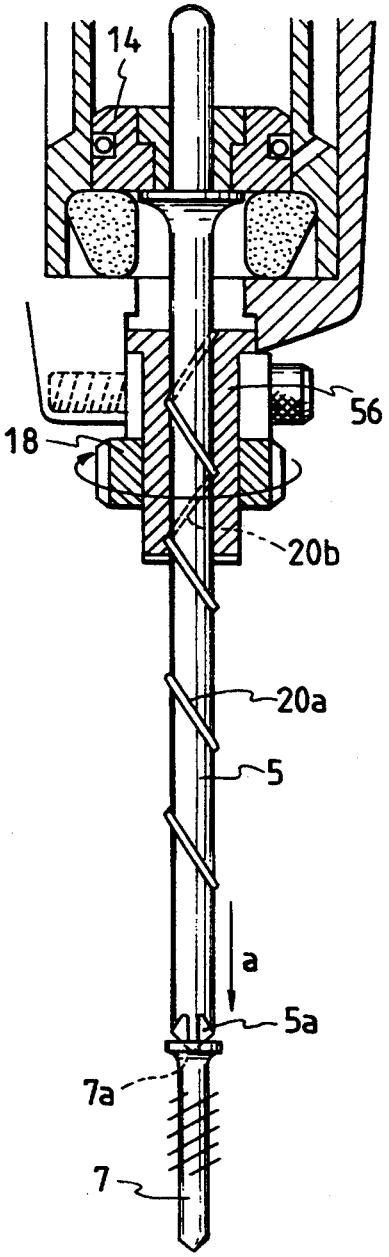
FIG. 11 is a fragmentary enlarged front view of the apparatus, particularly showing essential components constituting the apparatus.
Figure 12:
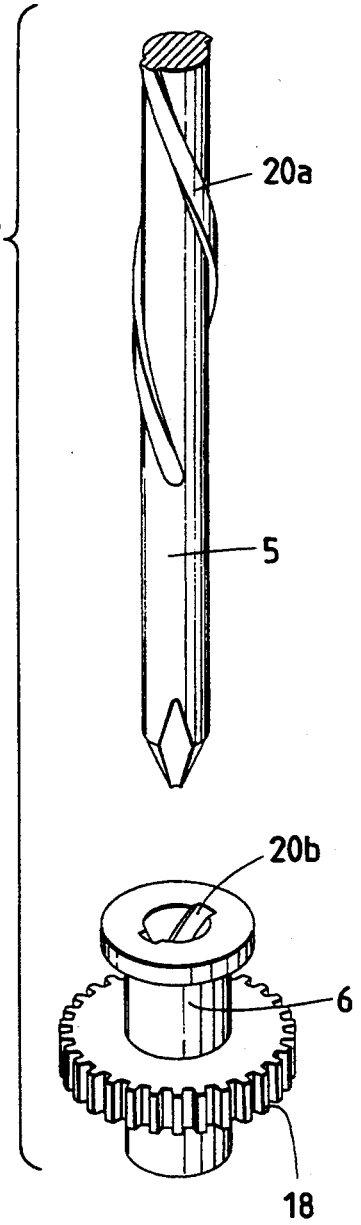
FIG. 12 is a fragmentary enlarged perspective view of the apparatus, particularly showing a driver bit and a bit guide constituting the apparatus in the disassembled state.

Next, FIG. 6 to FIG. 8 show by way of illustrative views the mechanism as explained in the paragraph (2). This mechanism is composed of a ground contacting member 26 projecting from the shooting portion 4, a support rod 27 standing upright from one end of the ground contacting member 26 while extending in parallel therewith, a pivotable arm 28 detachably disposed on the upper end of the support arm 27, and driving means for driving the pivotable arm 28. Slidable displacement of the support rod 27 is properly guided by a supporting/guiding portion 29 extending from the left-hand side of the shooting portion 4. The ground contacting member 26 is normally biased in the downward direction by the resilient power of a compression spring 30 disposed around the support rod 27 to support the shooting portion 4 away from the surface of a material 35 to be handled.

The driving means for the pivotable rotary arm is constructed such that one end of the rotary arm 28 is fixedly secured to the lower end of a pivotable rotary shaft 31 on the tool housing 1 with a vertical attitude, and a first gear 32 is fixedly secured to the upper end of the rotary shaft 31 so as to mesh with a rack member 19 of a piston-cylinder mechanism 10 having the same structure as that shown in FIG. 1. As shown in FIG. 6, before the piston-cylinder mechanism 10 is actuated, the foremost end part of the pivotable rotary arm 28 is located at the position where the pivotable rotary arm 28 is engaged with the upper end of the support arm 27 but when the piston-cylinder mechanism 10 is actuated, it is parted away from the upper end of the support arm 27.

A second gear 33 is fixedly fitted onto the rotational shaft 31 to mesh with a third gear 34 fixedly fitted onto the holding sleeve 6. Thus, as the piston-cylinder mechanism 10 is actuated, the holding sleeve 6 is rotationally driven via the first gear 32 to the third gears 34.

With such construction, prior to a screw striking operation, the ground contacting member 26 is projected downward of the lowermost end of the shooting portion 4 to come in contact with the material 35 to be handled. Subsequently, when the striking piston 2 reaches the lower dead point in conformity with the actuation of the striking mechanism, a striking screw 7 in the shooting portion 4 is hammered by the driver bit 5, and at the same time, the piston-cylinder mechanism 10 is actuated, whereby the pivotable rotary arm 28 is parted away from the support arm 27, resulting in the ground contacting member 26 being released from the supported state. As the tool housing 1 is depressed by an operator's hand, the shooting portion 4 is lowered, causing the ground contacting member 27 to be relatively upwardly displaced along the shooting portion 4 against the resilient power of the compression spring 30. Thus, since the ground contacting member 26 is relatively upwardly displaced as the tool housing 1 is depressed in that way after the screw striking operation is started, the striking screw 7 is driven until it is finally struck in the material to be handled. Thus, since the rotatable driving of the screw 7 is effected while the head portion of the striking screw 7 is held in the shooting portion 4 or the ground contacting member 26, each screwing operation can reliably be achieved.

In addition, a tool for handling a striking screw a screw according to a fourth embodiment of the present invention will now be described in detail hereinafter with reference to the accompanying FIGS. 9–12.

However, a structure and operation of the tool according to the fourth embodiment is basically the same as the first embodiment, so that a detailed explanation of the structure and operation in the same elements are omitted by utilizing the same reference numerals.

In the fourth embodiment, to properly guide the axial displacement of the driver bit 5, a bit guide 56 is rotatably disposed in the shooting portion 4. In addition, a piston cylinder mechanism 10 for rotatably driving the bit guide 56 in the screwing direction is arranged above a magazine 8 for feeding a screw 7 to the shooting portion 4. Further, a spirally extending ribbon-shaped projection **20*a* extending in the clockwise direction with a large pitch (see FIG. 12) is formed on the outer peripheral surface of the driver bit 5**.

The bit guide 56 is rotatably supported in the shooting portion 4, and the driver bit 5 is rotatably held in the bit guide 56. A spirally extending groove **20*b* (see FIG. 12), adapted to be engaged with the spirally extending ribbon-shaped projection 20*a* on the driver bit 5, is formed on the inner wall surface of the bit guide 56. It is obvious that the spirally extending groove 20*b* is formed in the clockwise direction, i.e. in the same direction as that of the spirally extending projection 20*a*. In addition, a gear 18 is integrated with the bit guide 56**.

With the apparatus constructed in the above-described manner, when the trigger lever 11 is actuated with an operator's finger, the striking mechanism is activated to drive the striking piston 2 in the downward direction, causing a screw 7 held in the shooting portion 4 to be struck with the striking piston 2. At this time, since the spirally extending ribbon-shaped projection **20*a* of the driver bit 5 is engaged with the spirally extending groove 20*b* of the bit guide 56 and the bit guide 56 is held so as not to be rotated relative to the driver bit 5, a high intensity of rotational power is applied to the driver bit 5 in the unscrewing direction (i.e., in the counterclockwise direction), whereby the driver bit 5 is displaced in the screw squeezing direction while rotating in the counterclockwise direction until it is engaged with the grooved head position of the screw 7. Thus, the engagement portion 5*a* of the driver bit 5 at the foremost end part of the latter is reliably fitted into the groove 7*a* formed in the head portion of the screw 7**.

It is preferable that the driver bit 5 is rotated within the striking/screwing stroke range by an angle equal to about $\frac{1}{4}$ to $\frac{1}{2}$ of one revolution.

The driver bit 5 is slidably displaced in the bit guide 56 to hammer the screw 7 and then rotatably driven it beyond the lowermost end of the shooting portion 4. While the foregoing state is maintained, about 10 to 20% of the axial length of screw 7 is held in the floated state while standing upright above the upper surface of an article into which it is to be fully driven.

Subsequently, a part of the compressed air accumulated in the blow-back chamber 13 during the striking operation is introduced into the three-way valve 22 via the air path 16, causing the three-way valve 22 to be actuated. When the three-way valve 22 is actuated in that way, the compressed air in the main chamber 12 is introduced into the driving cylinder 15 of the piston-cylinder mechanism 10 so that the driving piston 14 is driven by the compressed air, causing the rack member 19 to be displaced together with the driving piston 14 in the forward direction. Thus, as the bit guide 56 is rotated in the screwing direction via the meshing engagement of the rack **19*a* with the gear 18, the driver bit 5 is rotationally driven in the downward direction (see FIG. 10**).

On completion of the striking operation for the screw 7 performed by the striking piston 2, the foremost end part of the driver bit 5 is fitted into the groove **7*a* formed in the head portion of the screw 7, and thereafter, when the bit guide 56 is rotatably driven, the rotational power is applied to the driver bit 5 via the operative engagement of the spirally extending ribbon-shaped projection 20*a* of the driver bit 5 with the spirally extending groove 20*b* of the bit guide 56, causing the screw 7 to be rotatably driven in the screwing direction. At this time, a certain intensity of resisting force arises between the driver bit 5 and the bit guide 56 in the presence of resistance against the rotation of the screw 7, whereby the driver bit 5 is slidably displaced in the axial direction as the screw 7 is rotatably driven. Thus, not only the rotational force but also the thrusting force are applied to the screw 7 as the bit guide 56 rotatably drives the driver bit 5**.

When the foremost end part of the driver bit 5 is completely fitted into the groove **7*a* formed in the head portion of the screw 7, the thrusting power given by the driver bit 5 is received by the screw 7, causing the latter to be immediately rotated by the driver bit 5 via the operative engagement of the spirally extending ribbon-shaped projection 20*a* with the spirally extending groove 20*b*. When the driving apparatus is parted from the screw 7 due to a reactive force arising when the screw 7 is struck by the striking piston 2, or when the foremost end part of the driver bit 5 is incompletely fitted into the groove 7 formed in the head portion of the screw 7, the driver bit 5 is forcibly displaced in the downward direction by the thrusting power until the foremost end part of the driver bit 5 is completely fitted into the groove 7*a*** formed in the head portion of the screw 7. Thus, the rotatable driving operation of the screw 7 can be achieved reliably.

When the trigger lever 11 is released from the actuated state after completion of the rotatable driving operation, the striking piston 2 is displaced in a rearward direction by the action of the compressed air remaining in the blow-back chamber 13. At the same time, the driving piston 14 of the piston-cylinder mechanism 10 is displaced in the rearward direction by the resilient power of a coil spring, causing the rack member 19 to be displaced together with the driving piston 14 in the rearward direction, whereby the bit guide 56 is rotated in the unscrewing direction together with the gear 18 meshing with the rack 19*a* of the rack member 19. As the bit guide 56 is rotated in this way, the driver bit 5 is upwardly displaced while rotating in the clockwise direction. On completion of the upward displacement of the driver bit 5, the apparatus is ready to start a next striking/screwing operation.

Incidentally, rotational driving means for the bit guide 56 is not be limited only to the pinion-rack mechanism as mentioned above. Alternatively, for example, the bit guide 56 may be rotated by driving, e.g., a pneumatic motor.

In the fourth embodiment, the apparatus is constructed such that the spirally extending ribbon-shaped projection 20*a* is formed on the outer surface of the driver bit 5 and the spirally extending groove 20*b* is formed on the inner wall surface of the bit guide 56. Alternatively, in contrast with the aforementioned embodiment, the apparatus may be constructed such that a spirally extending groove is formed on the outer surface of the driver bit 5 and a spirally extending ribbon-shaped projection is formed on the inner wall surface of the bit guide 56.

According to the fourth embodiment of the present invention, since the spirally extending ribbon-shaped projection formed on the driver bit is operatively engaged with the spirally extending groove formed in the bit guide, as the driver bit is driven in the axial direction at the time of screw striking, the driver bit is rotated in the unscrewing direction. Thus, since the driver bit is displaced in the driving direction while rotating in the counterclockwise direction until the driver bit is engaged with the grooved screw head, the cross-shaped (i.e., Phillips-type) engagement portion of the driver bit at the foremost end part of the latter is positionally aligned with the groove formed in the head portion of the screw during the rotation of the driver bit, whereby the former is reliably fitted into the latter. Thus, there does not arise a malfunction that the groove formed in the head portion of the screw is undesirably damaged or injured by the driver bit.

In addition, since the thrusting force is applied to the driver bit in the downward direction during the rotatable driving (i.e. screwing) operation of the screw via the operative engagement of the spirally extending ribbon-shaped projection formed on the driver bit with the spirally extending groove formed in the bit guide, causing the screw to be normally driven in the downward direction, the cross-shaped engagement portion of the driver bit is completely fitted into the engagement groove formed in the head portion of the screw. Consequently, the screwing operation can reliably be achieved without any occurrence of a malfunction that the groove formed in the head portion of the screw is undesirably damaged or injured by the driver bit.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in various embodiments and suited to the particular use contemplated.

What is claimed is:

1. A tool for handling a striking screw comprising:

a driving means for impulsively driving said striking screw in a longitudinal direction of said striking screw, said driving means being provided with a driver bit having an engagement portion formed at the foremost end of said driver bit for engaging with an engagement groove formed in the head portion of said striking screw to be driven;

a guiding means for preventing said driver bit from rotating in a screwing direction of said striking screw while said striking screw is driven and for guiding a movement of said driver bit in said longitudinal direction of said striking screw; and means for rotating said driver bit in such a manner that said striking screw is rotatably driven by rotating said driver bit together with said guiding means in a screwing direction.

2. A tool for handling a striking screw according to claim 1, in which said driving means comprises:

a striking cylinder;

a striking piston slidably received in said striking cylinder; and said driver bit rotatably supported by said striking piston so as to guide the slidable displacement of said driver bit in a shooting portion formed at one end part of said striking cylinder.

3. A tool for handling a striking screw according to claim 2, in which said guiding means comprises:

a driver bit holding sleeve disposed in said shooting portion so as to enable said driver bit holding sleeve to be rotated together with said driver bit in the same direction while permitting the slidable displacement stroke of said driver bit across the whole length of a slidable displacement stroke of said driver bit.

4. A tool for handling a striking screw according to claim 3, in which said driver bit rotating means comprises:

a piston-cylinder mechanism, including a driving piston adapted to be reciprocably displaced within a predetermined stroke range, adjacent said shooting portion, wherein said piston-cylinder mechanism is operatively associated with said driver bit holding sleeve via a converting mechanism for converting linear movement of said driving piston into rotary movement of said driver bit holding sleeve.

5. A tool for handling a striking screw as claimed in claim 4, wherein said striking piston has an operative direction of action, wherein said driver bit is slidably displaceable in said operative direction beyond a distance which said striking piston travels in said operative direction.

6. A tool for handling a striking screw according to claim 1, in which a spirally extending ribbon-shaped projection is formed on said driver bit and a spirally extending groove is formed on a bit guide of said guiding means for guiding the slidable movement of said driver bit so as to impart a rotational force to said screw in a direction opposite to the screwing direction of said screw via the operative engagement of said spirally extending ribbon-shaped projection with said spirally extending groove when said screw is driven in the striking direction.

7. A tool for handling a striking screw according to claim 1, in which said bit guide is engageable with said driver bit rotating means to rotate said bit guide together with said driver bit in the screwing direction.

8. A tool for handling a striking screw according to claim 7, wherein said bit guide is rotatably fixed when said striking piston is operatively actuated, said bit guide being rotatably driveable thereafter.

9. A tool for handling a striking screw as claimed in claim 2, further comprising a ground contacting member disposed adjacent to said shooting portion and extending outwardly in contact with a material into which the screw is driven, said ground contacting member being slidably movable in a direction parallel to a direction in which the striking screw is driven, wherein, when said striking piston is operatively actuated, said ground contact member is movable in a direction opposite to the driving direction of the striking screw.

10. A tool for handling a striking screw, comprising:

a striking cylinder;

a striking piston slidably received in said striking cylinder;

a slidably displaceable driver bit rotatably supported by said striking piston to allow the slidable displacement of said driver bit to be properly guided in a shooting portion formed at one end part of said striking cylinder, wherein a foremost end of said driver bit has an engagement portion adapted to be engaged with an engagement groove formed in a head portion of the striking screw fed to said shooting portion;

a driver bit holding sleeve disposed in said shooting portion to enable said holding sleeve to be rotated together with said driver bit in the same direction while permitting the slidable displacement of said driver bit across the whole length of a slidable displacement stroke of said driver bit; and a piston-cylinder mechanism including a driving piston adapted to be reciprocally displaced within a predetermined stroke range being arranged adjacent to said shooting portion, said piston-cylinder mechanism being operatively associated with said holding sleeve via a converting mechanism for converting linear movement of said driving piston into rotary movement of said holding sleeve.

11. A tool for handling a striking screw as claimed in claim 10, wherein said striking piston has an operative direction of action, wherein said driver bit is slidably displaceable in said operative direction beyond a distance which said striking piston travels in said operative direction.

12. A tool for handling a striking screw as claimed in claim 11, further comprising a ground contacting member disposed adjacent to said shooting portion and extending outwardly in contact with a material into which the screw is driven, said ground contacting member being slidably movable in a direction parallel to a direction in which the striking screw is driven, wherein, when said striking piston is operatively actuated, said ground contact member is movable in a direction opposite to the driving direction of the striking screw.

* * * * *